US009815289B2

(12) United States Patent
Ness et al.

(10) Patent No.: US 9,815,289 B2
(45) Date of Patent: Nov. 14, 2017

(54) ENCRYPTION OF FLUID CARTRIDGES FOR USE WITH IMAGING DEVICES

(71) Applicant: Hewlett-Packard Development Company, L.P., Houston, TX (US)

(72) Inventors: Erik D. Ness, Vancouver, WA (US); Huston W. Rice, Vancouver, WA (US); Brendan Hall, Leixlip (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/498,224

(22) Filed: Apr. 26, 2017

(65) Prior Publication Data

US 2017/0225476 A1 Aug. 10, 2017

Related U.S. Application Data

(63) Continuation of application No. PCT/US2014/063381, filed on Oct. 31, 2014.

(51) Int. Cl.
*B41J 2/175* (2006.01)
*B41J 2/195* (2006.01)

(52) U.S. Cl.
CPC ..... *B41J 2/17546* (2013.01); *B41J 2/17503* (2013.01); *B41J 2/17526* (2013.01)

(58) Field of Classification Search
CPC ..... B41J 2/17546; B41J 2/17503; B41J 2/17526; B41J 2/17543; B41J 2/0458; B41J 2/04541; B41J 2202/17
USPC ..... 347/5, 7, 19, 86, 87
See application file for complete search history.

(56) References Cited

U.S. PATENT DOCUMENTS

| | | | |
|---|---|---|---|
| 2003/0146951 | A1 | 8/2003 | Skene et al. |
| 2003/0184624 | A1 | 10/2003 | Kinalski |
| 2006/0050103 | A1 | 3/2006 | Naka |
| 2009/0225609 | A1 | 9/2009 | Asauchi et al. |

FOREIGN PATENT DOCUMENTS

| | | |
|---|---|---|
| CN | 1345004 | 4/2002 |
| JP | 2009300758 | 12/2009 |
| WO | 2016068990 | 5/2016 |

OTHER PUBLICATIONS

International Searching Authority, "International Search Report," issued in connection with International Patent Application No. PCT/US2014/063381, dated Jul. 21, 2015 (4 pages).
International Searching Authority, "Written Opinion," issued in connection with International Patent Application No. PCT/US2014/063381, dated Jul. 21, 2015 (8 pages).
Taiwan Intellectual Property Office, "Two Month Office Action", issued in connection with Taiwanese application No. 10620528290, dated May 17, 2017 (5 pages).

*Primary Examiner* — An Do
(74) *Attorney, Agent, or Firm* — Hanley Flight & Zimmerman, LLC

(57) ABSTRACT

Encryption of fluid cartridges for use with imaging devices is disclosed herein. One disclosed apparatus includes a memory of a fluid cartridge comprising a plurality of sequential bits, where the plurality of sequential bits are written to the memory after the plurality of sequential bits are transformed based on scrambling bits of the plurality of sequential bits, and a memory interface of the fluid cartridge to enable access to the memory to authenticate the fluid cartridge.

12 Claims, 7 Drawing Sheets

ENCRYPTION OF FLUID CARTRIDGES FOR USE WITH IMAGING DEVICES

RELATED APPLICATION

This patent as a continuation of International Patent Application No. PCT/US14/63381, which was filed on Oct. 31, 2014, and which is hereby incorporated herein by reference in its entirety.

BACKGROUND

Ink-based imaging devices utilize ink to print images on media. Typically, ink contained in fluid cartridges (e.g., ink cartridges, cartridges) is depleted over time and the cartridges must be eventually replaced to continue operation of the imaging device. Installation or replacement of a cartridge into an imaging device (e.g., a printer, a scanner, a copier, etc.) sometimes requires authentication and/or verification of the cartridge prior to use with the imaging device. In some situations, it is advantageous to have reliable authentication and/or verification device to verify a cartridge in an uncontrolled environment (e.g., a consumer environment).

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
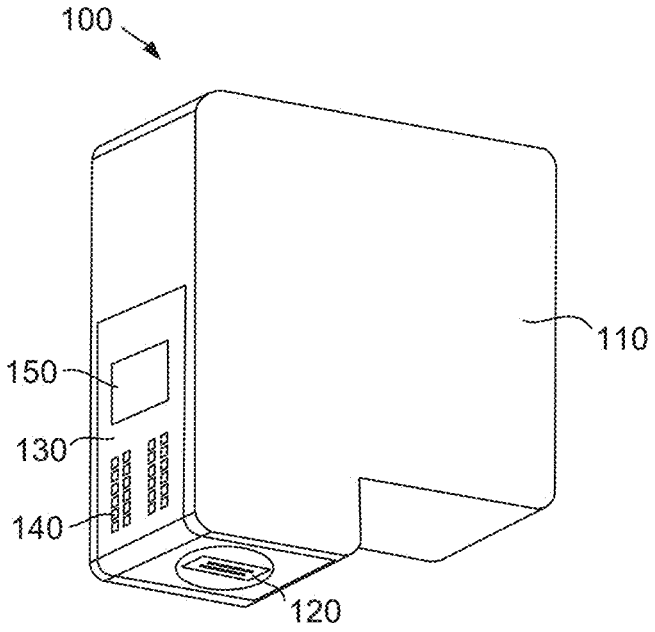
FIG. 1 is an example fluid cartridge in which the examples disclosed herein may be implemented.

Encryption of fluid cartridges for use with imaging devices is disclosed herein. Typically, fluid cartridges (e.g., ink cartridges, cartridges, etc.) for use with imaging devices (e.g., printers, scanners, copiers, etc.) require replacement due to depletion of ink contained in the fluid cartridges. Some known cartridges have read-only memory with a bit sequence for verification of these cartridges by the imaging devices. In these known examples, the entire bit sequence or a portion of the bit sequence of a cartridge is verified to contain acceptable values against a pre-determine criteria by the imaging device to authorize the cartridge. In order to reverse-engineer these cartridges, third-parties may sample multiple cartridges to determine which addresses or portions of the bit sequence are consistent between the multiple cartridges sampled to create un-authorized cartridges.

The examples disclosed herein provide an encryption and/or decryption technique to prevent reverse-engineering of cartridges to prevent the use and/or distribution of unauthorized cartridges. In particular, the examples disclosed herein transform a plurality of sequential bits (e.g., a bit sequence, a plurality of bits, etc.) corresponding to a memory (e.g., copied from or to be written to a memory bank) of a cartridge based on scrambling bits of the plurality of sequential bits. In some examples, the scrambling bits are bits at pre-defined or known addresses of the plurality of sequential bits that are used to define how to shift and/or re-arrange non-static bits (e.g., bits allowed to be re-arranged, transformed, shifted, etc.) of the plurality of sequential bits. In some examples, static bits of the plurality of sequential bits remain the same and/or are not moved, shifted and/or re-sequenced. In some examples, the static bits and/or a portion of the static bits define the scrambling bits. The examples disclosed herein may be used in conjunction with other security, verification and/or encryption methods to prevent cartridges from being reverse-engineered.

The examples disclosed herein enable an authentication memory of a cartridge to be programmed by determining scrambling bits of a plurality of sequential bits for the authentication memory of the cartridge, transforming, using a processor, the plurality of sequential bits based on the scrambling bits, and storing the transformed plurality of sequential bits to the authentication memory. In some examples, transforming the plurality of sequential bits comprises shifting non-static bits of the plurality of sequential bits based on the scrambling bits. In some examples, the scrambling bits are excluded from being transformed. In some examples, the scrambling bits are at pre-defined memory locations of the authentication memory. In some examples, transforming the plurality of sequential bits is based on an algorithm determined from the scrambling bits.

As used herein, the term "transforming" or "moving" in reference to a bit and/or a bit sequence may refer to moving and/or shifting a bit in memory or moving a bit of a copy of a bit sequence in random-access memory (RAM). The bit sequence may be copied or received from read-only memory (ROM) or erasable programmable read-only memory (EPROM, EPROM device, etc.) of an imaging device, for example. "Moving" or "shifting" may also refer to copying a bit or a bit sequence from one address or array location to another address of an array. As used herein, the term "recursively" refers to moving between ends of a bit sequence. For example, a bit shifted or moved from at or near an end of a one-dimensional array (e.g., a bit sequence) may be moved to the beginning of the one-dimensional array and so forth.

FIG. 1 is an example fluid cartridge (e.g., ink cartridge, print cartridge, etc.) 100 in which the examples disclosed herein may be implemented. The example cartridge 100 includes a fluid reservoir 110, a die 120 including nozzles, a flex cable (e.g., a flexible printed circuit board) 130, conductive pads 140 and a memory chip (e.g., a memory, a memory device, a memory bank, etc.) 150. The flex cable 130 of the illustrated example is coupled (e.g., adhered and/or mounted) to sides of the cartridge 100 and includes traces and/or a memory interface (e.g., memory interface circuitry, etc.) that electrically couple the memory chip 150, the die 120 and the conductive pads 140. In some examples, the memory chip 150 and/or functionality associated with the memory chip 150 is integrated with the die 120 and/or a printhead circuit assembly.

The memory chip 150 of the illustrated example includes an authentication bit sequence. In this example, the memory chip 150 may also include a variety of other information including the type of cartridge, the type of fluid contained in the cartridge, an estimate of the amount of fluid in the fluid reservoir 110, calibration data, error information, maintenance information and/or other data.

Figure 2:
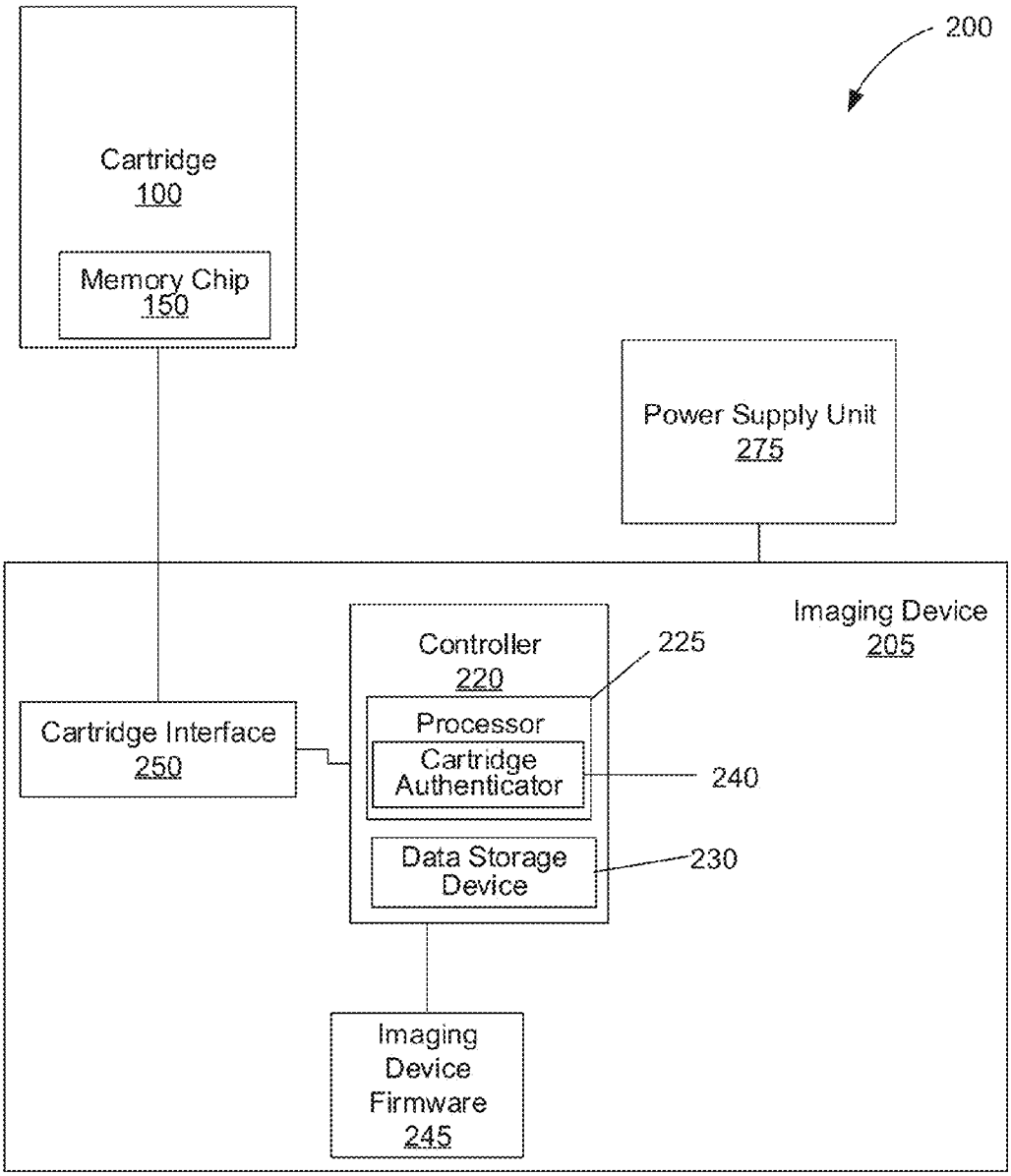
FIG. 2 illustrates a schematic representation of a cartridge authentication system in accordance with the teachings of this disclosure.

FIG. 2 illustrates a schematic representation of a cartridge authentication system 200 in accordance with the teachings of this disclosure. In this example, the cartridge authentication system 200 has an imaging device 205 (e.g., a printer) communicatively coupled with the cartridge 100 described above in connection with FIG. 1. The imaging device 205 of the illustrated example includes a controller 220, which has a processor 225, a data storage device 230 and a cartridge authenticator 240, which may be implemented by the processor 225. The imaging device 205 also includes imaging device firmware 245, which may be stored on the data storage device 230, and a cartridge interface 250. The firmware 245 of the illustrated example is executed by the processor 225 and causes and/or initiates the processor 225 to access the memory chip 150 of the cartridge 100. In this example, a power supply unit 275 coupled to the imaging device 205 provides power for both the imaging device 205 and the cartridge 100.

In operation, the example cartridge 100 is installed in a carriage cradle of the example imaging device 205. The imaging device 205 of the illustrated example is communicatively coupled to the cartridge 100 to authenticate the cartridge 100 and/or control the cartridge 100 via the cartridge interface 250. The cartridge interface 250 of the illustrated example consists of electrical contacts of the imaging device 205 in contact with the conductive pads 140 shown above in connection with FIG. 1 when the cartridge 100 is installed in the cradle of the imaging device 205 to enable the imaging device 205 to communicate with the cartridge 100, control the electrical or ink deposition functions of the cartridge 100, and/or verify the authenticity of the cartridge 100. To authenticate the cartridge 100, the imaging device 205 accesses a memory address of the memory chip 150 via the cartridge interface 250 to receive an authentication bit sequence (e.g., an array, a bit array, etc.) from the memory chip 150, for example. The authentication bit sequence may be a 256-bit sequence or any other appropriate size (16-bit, 1024-bit, etc.). In some examples, the authentication bit sequence may be a multi-dimensional array. In some examples, the entire authentication bit sequence is read in a single step.

In this example, the processor 225, based on instructions provided by the imaging device firmware 245, receives the authentication bit sequence from the memory chip 150 via the cartridge interface 250 and forwards the authentication bit sequence to the cartridge authenticator 240, which transforms (e.g., shifts, re-arranges, scrambles, re-assigns, transposes, etc.) the authentication bit sequence to verify the authenticity of the cartridge 100. In particular, the cartridge authenticator 240 of the illustrated example determines scrambling bits (e.g., the scrambling bit values) by accessing portion(s) of the authentication bit sequence at pre-defined and/or known addresses of the bit sequence. In some examples, the scrambling bits (e.g., values of the scrambling bits) indicate to the cartridge authenticator 240 and/or the processor 225 a number of address locations to shift the bits of the authentication bit sequence. In some examples, an arithmetic operation defined by and/or between the scrambling bits indicates and/or defines how the cartridge authenticator 240 is to transform the authentication bit sequence. In some examples, the cartridge authenticator 240 has pre-defined transform functions initiated by specific scrambling bit values and/or a relationship between the scrambling bit values (e.g., a sum, etc.). In particular, the scrambling bit values may be compared to a table to select the pre-defined transform function(s) to transform the authentication bit sequence. In some examples, bits of the authentication bit sequence define a number of transformation cycles to transform the authentication bit sequence.

In this example, after transforming the bit sequence, the cartridge authenticator 240 verifies the transformed bit sequence. This verification may occur by verifying the transformed bit sequence against a known value, a predetermine criteria, a checksum, mathematical operations, or any other appropriate verification of a number sequence. In this example, once the transformed bit sequence has been authenticated, the cartridge authenticator 240 provides a signal to the processor 225 and/or the cartridge interface 250 to enable use and/communication between the controller 220 and the cartridge 100 via the cartridge interface 250. In some examples, the controller 220 sends an authorization signal to the cartridge 100 to enable use of the cartridge 100 with the imaging device 205.

Figure 3:
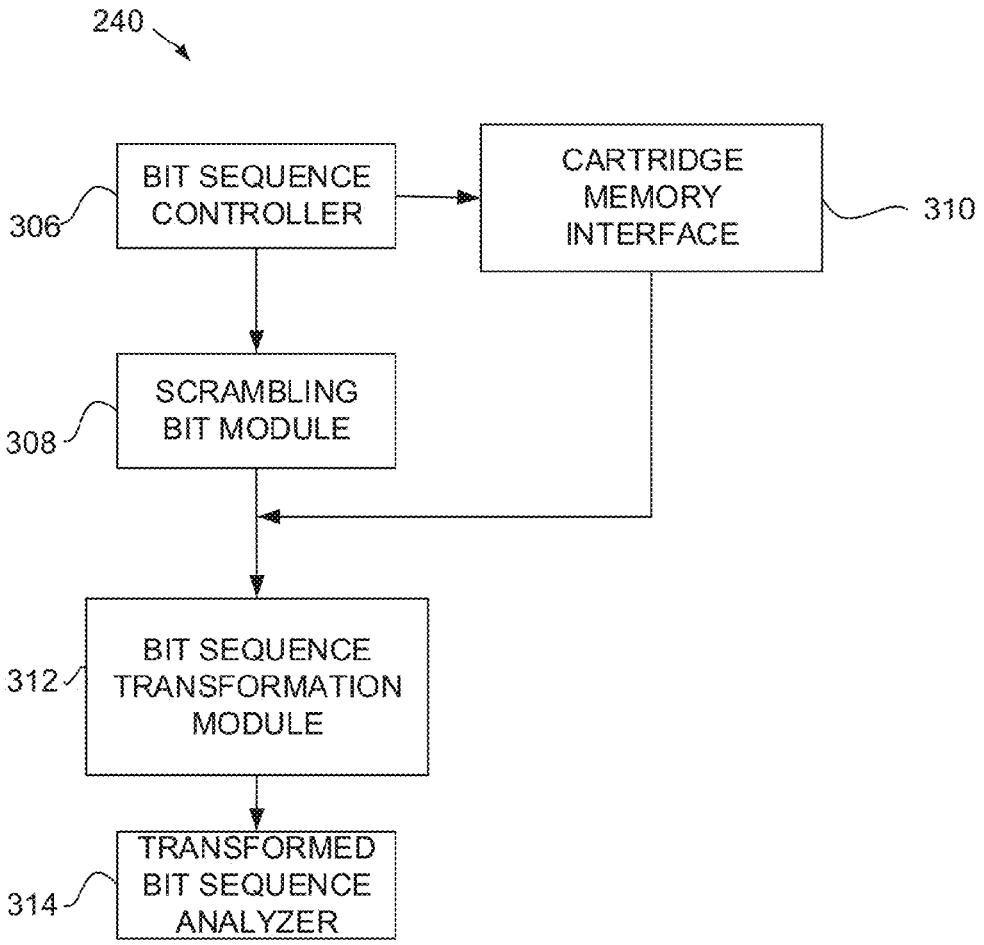
FIG. 3 illustrates a schematic representation of one example implementation of an example cartridge authenticator of an imaging device of the cartridge authentication system of FIG. 2.

FIG. 3 illustrates a schematic representation of one example implementation of the example cartridge authenticator 240 of the imaging device 205 of FIG. 2. The cartridge authenticator 240 of the illustrated example includes a bit sequence controller 306, a scrambling bit module 308, a cartridge memory interface 310, a bit sequence transformation module 312, and a transformed bit sequence analyzer 314. The bit sequence controller 306 of the illustrated example signals the cartridge memory interface 310 to retrieve an authentication bit sequence from a memory (e.g., a memory, a memory data structure, etc.) of a cartridge (e.g., the cartridge 100) and provide the authentication bit sequence to the bit sequence transformation module 312. In this example, the bit sequence controller 306 triggers the scrambling bit module 308 to provide data, such as memory locations of scrambling bits of the authentication bit sequence and/or the scrambling bits of the authentication bit sequence (e.g., scrambling bit values, converted scrambling bit values, etc.), to the bit sequence transformation module 312 to enable the bit sequence transformation module 312 to transform the authentication bit sequence received from the cartridge memory interface 310 based on the scrambling bits. In some examples, transformation of the authentication bit sequence is further based on static bits of the authentication bit sequence. In some examples, the scrambling bits are excluded from the transformation process.

After the bit sequence transformation module 312 has transformed the authentication bit sequence, the transformed authentication bit sequence is provided to the transformed bit sequence analyzer 314, which verifies the transformed authentication bit sequence. In some examples, the transformed bit sequence analyzer interprets a command based on verifying the transformed bit sequence and/or comparing the received transformed bit sequence to a table of known transformed bit sequences.

Figure 4:
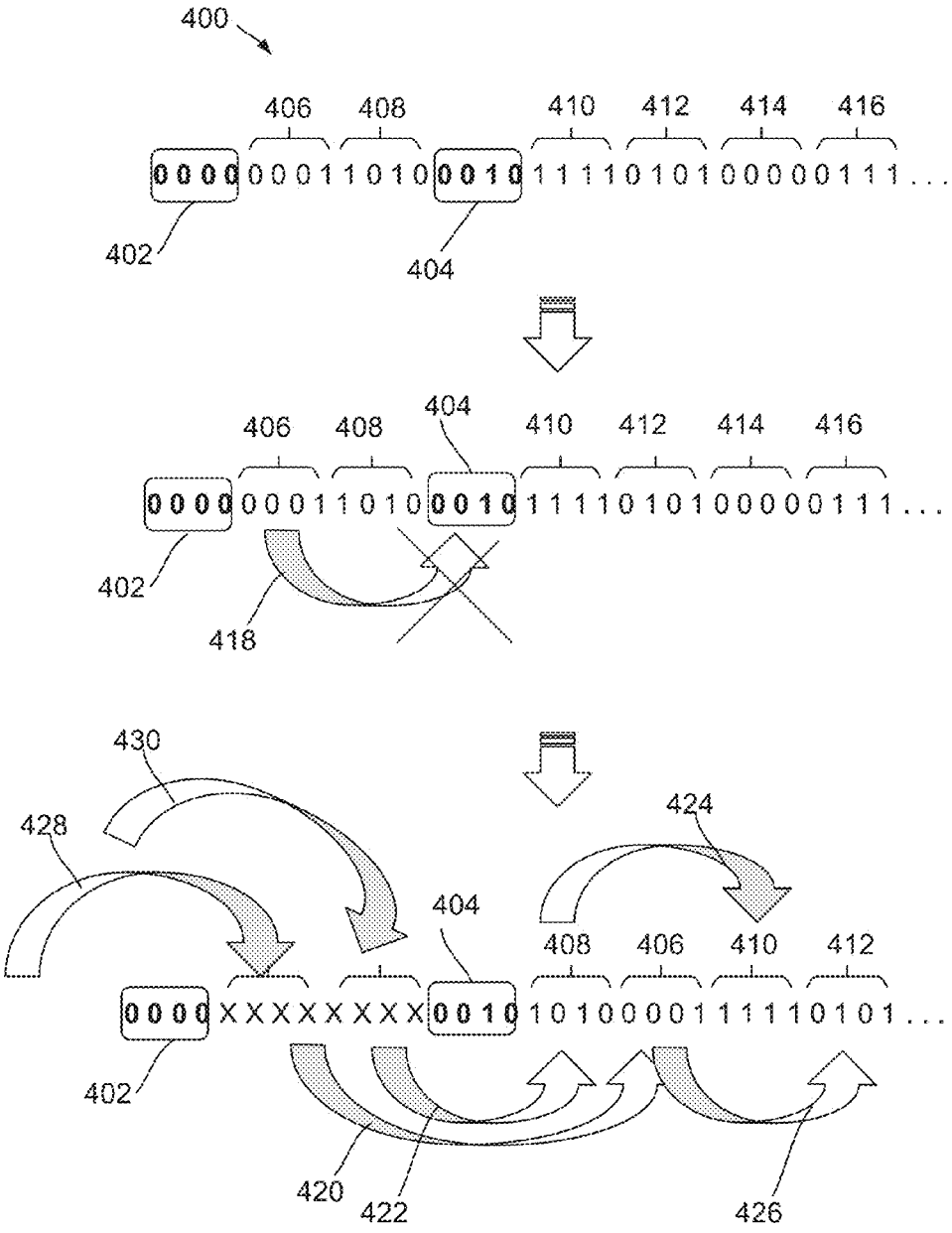
FIG. 4 illustrates an example bit array that is manipulated to a sequence of bit encryption steps that may be used in the examples disclosed herein.

FIG. 4 illustrates an example bit array 400 that is manipulated to a sequence of bit encryption steps. The example bit array 400 is subdivided into 4-bit binary sequences. The bit array 400 of the illustrated example has static bits (e.g., subsets, portions, sequences, etc.) 402 and 404 at pre-defined (e.g., known) address locations of the example bit array 400. In some examples, the static bits 402 and 404 are distributed randomly throughout the example bit array 400. In this example, the remaining bits of the example bit sequence are non-static (e.g., movable, writable, etc.). In particular, the example bit array has non-static bit sequences (e.g., portions) 406, 408, 410, 412, 414 and 416.

In this example, scrambling bits of the example bit array 400, which may be located at pre-defined addresses of the bit array 400, and/or a relationship between the scrambling bits define and/or indicate a transformation method or instructions to transform the example bit array 400. In this example, the scrambling bits are the static bits 402 and 404 that define a shift of each non-static bit of two memory locations. In particular, a binary value of a sum of the static bit 402 and the static bit 404 equals a value of two, which is used to define how many address locations to shift each of the non-static bits of the example bit array 400, for example. In this example, the scrambling bits are equal to the static bits 402 and 404, and are excluded from being shifted and/or moved. However, in some examples, at least one of the non-static bits comprises the scrambling bits and the scrambling bits may be moved and/or shifted. While a sum of the scrambling bits of the illustrated are used in this example, more complex operations (e.g., multi-step arithmetic operations, varying operations between different memory locations and/or addresses, etc.) between the static bits and/or between the static and non-static bits may be used to define a transformation pattern.

The bit sequence (e.g., portion) 406 of the example bit array 400 is about to be shifted two address locations as directed by the sum of the static bits 402 and 404 and indicated by an arrow 418. However, because the static bits 404 are a designated static location, the bit sequence 406 does not overwrite the static bits 404. Instead, the bit sequence 406 is shifted an additional two addresses as indicated by an arrow 420. Because the bit sequence 408 does not have static bits two memory addresses away from of the bit sequence 408, the bit sequence 408 is moved as indicated by an arrow 422. Similarly, the bit sequence 410 is moved two address locations as indicated by an arrow 424, and the bit sequence 412 is also moved as indicated by an arrow 426. In this example, the bit sequences 414 and 416 are moved to later portions of the example bit array 400 (e.g., two memory addresses as defined by the static bits 402 and 404).

As the bit sequences (e.g., portions) 406, 408, 410, 412, 414 and 416 are shifted to their corresponding memory addresses during the transformation process, arrows 428 and 430 indicate bit sequences from later portions (e.g., near or at an end of the bit array 400), which are represented by "XXXX," of the authentication bit sequence moved (e.g., recursively moved) to memory addresses after the static bits 402.

In some examples, the static bits 402, 404 are used to convey information to an imaging device and/or used for manufacturing or operational processes (e.g., signifying manufacturing codes such as lot codes, serial number, etc.). While the example of FIG. 4 illustrates shifts in one direction, the shifts may occur in an opposite direction or some bits may be shifted in different directions from other bits, for example. In some examples, different bits are shifted by different amount of address locations, which may be defined by the scrambling bits, static bits and/or static bit locations. While the examples described above are related to a one-dimensional (1-D) array, the examples disclosed herein may be applied to multidimensional arrays. Additionally, or alternatively, the scrambling bits may define shifting in more than one direction and/or dimension for multidimensional arrays. In some examples, the transformation and/or re-sequencing of the bits is performed in a single step, which may be performed by a multi-threaded processor, for example.

Figure 5:
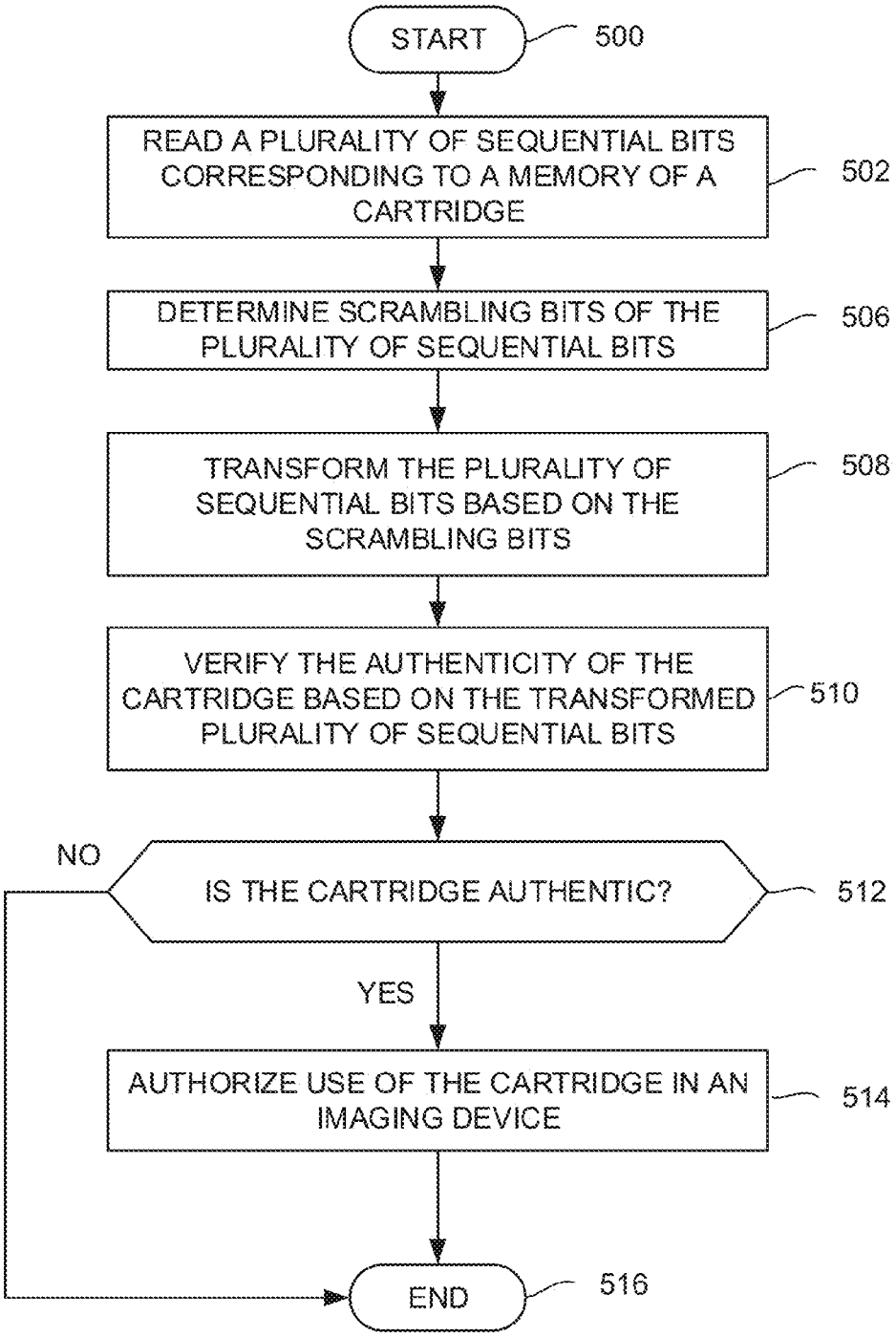
FIG. 5 is a flowchart representative of example machine readable instructions that may be executed to implement the example cartridge authentication system of FIG. 2.
Figure 6:
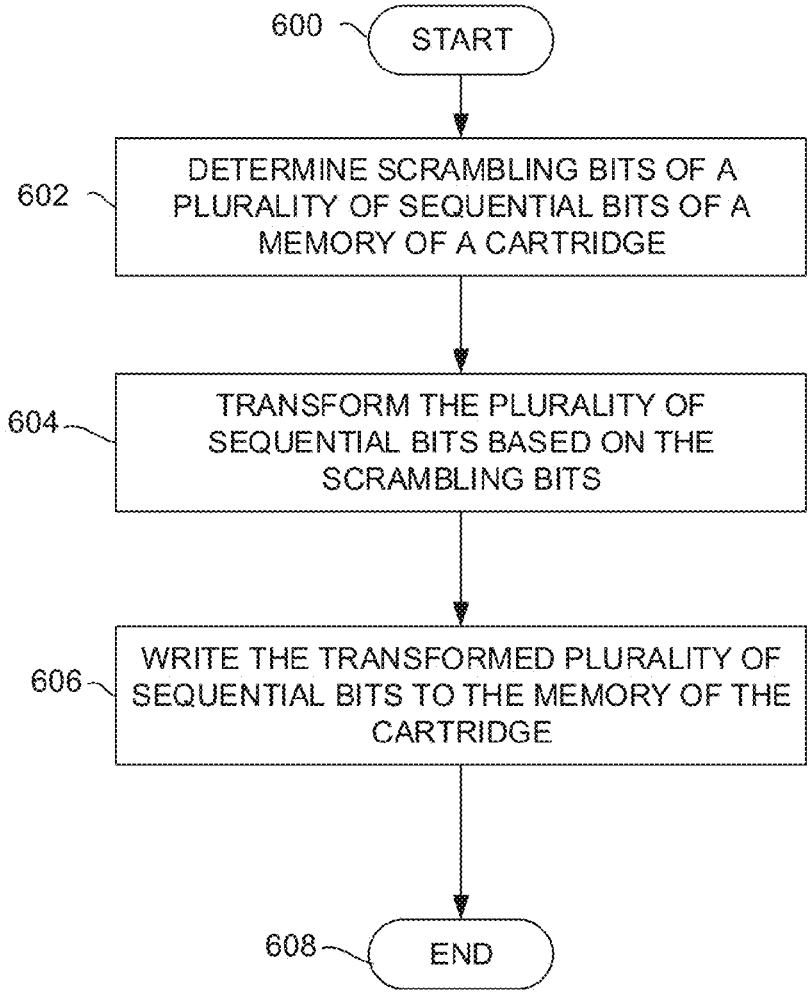
FIG. 6 is another flowchart representative of example machine readable instructions that may be executed to implement the example cartridge of the example cartridge authentication system of FIG. 2.

While an example manner of implementing the cartridge authentication system 200 of FIG. 2 is illustrated in FIGS. 5 and 6, one or more of the elements, processes and/or devices illustrated in FIGS. 5 and 6 may be combined, divided, re-arranged, omitted, eliminated and/or implemented in any other way. Further, the example imaging device 205, the example controller 220, the example processor 225, the example data storage device 230, the example cartridge authenticator 240, the example imaging device firmware 245, the example cartridge interface 250, the example cartridge 100, the example memory chip 150, the example bit sequence controller 306, the example static bit module 308, the example cartridge memory interface 310, the example bit sequence transformation module 312, the example transformed bit sequence analyzer 314 and/or, more generally, the example cartridge authentication system 200 of FIG. 2 may be implemented by hardware, software, firmware and/or any combination of hardware, software and/or firmware. Thus, for example, any of the example imaging device 205, the example controller 220, the example processor 225, the example data storage device 230, the example cartridge authenticator 240, the example imaging device firmware 245, the example cartridge interface 250, the example cartridge 100, the example memory chip 150, the example bit sequence controller 306, the example scrambling bit module 308, the example cartridge memory interface 310, the example bit sequence transformation module 312, the example transformed bit sequence analyzer 314 and/or, more generally, the example cartridge authentication system 200 of FIG. 2 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)).

When reading any of the apparatus or system claims of this patent to cover a purely software and/or firmware implementation, at least one of the example imaging device 205, the example controller 220, the example processor 225, the example data storage device 230, the example cartridge authenticator 240, the example imaging device firmware 245, the example cartridge interface 250, the example cartridge 100, the example memory chip 150, the example bit sequence controller 306, the example scrambling bit module 308, the example cartridge memory interface 310, the example bit sequence transformation module 312 and/or the example transformed bit sequence analyzer 314 is/are hereby expressly defined to include a tangible computer readable storage device or storage disk such as a memory, a digital versatile disk (DVD), a compact disk (CD), a Blu-ray disk, etc. storing the software and/or firmware. Further still, the example cartridge authentication system 200 of FIG. 2 may include one or more elements, processes and/or devices in addition to, or instead of, those illustrated in FIGS. 5 and 6, and/or may include more than one of any or all of the illustrated elements, processes and devices.

Flowcharts representative of example machine readable instructions for implementing the cartridge authentication system 200 of FIG. 2 is shown in FIGS. 5 and 6. In this example, the machine readable instructions comprise a program for execution by a processor such as the processor 712 shown in the example processor platform 700 discussed below in connection with FIG. 7. The program may be embodied in software stored on a tangible computer readable storage medium such as a CD-ROM, a floppy disk, a hard drive, a digital versatile disk (DVD), a Blu-ray disk, or a memory associated with the processor 712, but the entire program and/or parts thereof could alternatively be executed by a device other than the processor 712 and/or embodied in firmware or dedicated hardware. Further, although the example program is described with reference to the flowcharts illustrated in FIGS. 5 and 6, many other methods of implementing the example cartridge authentication system 200 may alternatively be used. For example, the order of execution of the blocks may be changed, and/or some of the blocks described may be changed, eliminated, or combined.

As mentioned above, the example processes of FIGS. 5 and 6 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example processes of FIGS. 5 and 6 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

FIG. 5 is a flowchart representative of example machine readable instructions that may be executed to implement the example cartridge authentication system of FIG. 2. The program of FIG. 5 begins at block 500 where a cartridge (e.g., the cartridge 100) with an authentication memory (e.g., the memory chip 150) has been inserted into an imaging device (e.g., the imaging device 205) (block 500). In this example, insertion of the cartridge triggers an interface (e.g., the cartridge memory interface 310 of the cartridge authenticator 240) of a controller (e.g., the controller 220) of the imaging device to read and/or receive an authentication bit sequence of the authentication memory of the cartridge (block 502). In this example, the controller of the imaging device determines scrambling bits (e.g., determines values of the scrambling bits) of the authentication bit sequence by accessing known address locations of the authentication bit sequence (block 506). In this example, the scrambling bit address locations are defined by a scrambling bit module such as the scrambling bit module 308 described above in connection with FIG. 3.

Next, a bit sequence transformation module (e.g., the bit sequence transformation module) of the cartridge authenticator transforms (e.g., rearranges, shifts, transposes, etc.) the authentication bit sequence based on the scrambling bits, mathematical operations of the scrambling bits, and/or mathematical operations between the scrambling bits and the authentication bit sequence, and or any other appropriate transformation and/or scrambling algorithm (block 508). In some examples, the scrambling bits are excluded from this transformation process. Additionally or alternatively, the scrambling bits define or indicate how many address locations to shift each bit and/or a direction along the bit sequence in which one or more bits are to be moved. In some examples, the transformation of the authentication bit sequence may occur through multiple cycles of moving and/or reassigning bits (e.g., a recursive process that is repeated multiple times). In some examples, the scrambling bits, values of the scrambling bits and/or values resulting from mathematic operations of the scrambling bits are compared to a table to determine a transformation algorithm to be applied to the authentication bit sequence. In some examples, the transformation is further based on static bits of the authentication bit sequence.

The transformed authentication bit sequence is then verified to determine whether the cartridge is authentic, for example (block 510). As mentioned above, this verification may occur through the transformed bit sequence being an expected value, checksums, and/or any other appropriate verification process. If the cartridge is determined to be authentic (block 512), the cartridge is authorized for use with the imaging device (block 514), and the process ends (516). However, if the cartridge is determined not to be authentic (block 512), the process ends (block 516) until the cartridge is re-inserted or another cartridge is inserted into the imaging device.

While the example of FIG. 5 is described in relation to verifying the cartridge, the example process and/or portions of the example process may also be used to encrypt the cartridge (e.g., to write the transformed authentication bit sequence to the memory of the cartridge). Alternatively, portions of the process of FIG. 5 may be reversed and/or re-ordered for other purposes.

FIG. 6 is another flowchart representative of example machine readable instructions that may be executed to implement the example cartridge 100 of the cartridge authentication system 200 of FIG. 2. In this example, a cartridge is being programmed and/or encoded with an authentication bit sequence to prevent third-parties from reverse-engineering the cartridge and to allow the cartridge to be later verified by an imaging device. The program of FIG. 6 begins at block 600 where the cartridge (e.g., the cartridge 100) is being prepared to be programmed, encoded and/or receive the authentication bit sequence in a memory (e.g., the memory chip 150), for example (block 600). In this example, scrambling bits of the authentication bit sequence are determined and/or defined (block 602). In particular, addresses of the scrambling bits of the illustrated example are known. In some examples, the authentication bit sequence and/or the scrambling bits are defined and/or provided by a programming computer and/or device.

Next, in this example, the authentication bit sequence is transformed based on the determined and/or defined scrambling bits (block 604). In some examples, the transformation is further based on static bits of the authentication bit sequence. In this example, the static bits are excluded from the transformation process. In some examples, the scrambling bits are in static bit locations. In some examples, the scrambling bits are excluded from the transformation process and are used by the imaging device for verification of the cartridge via another transformation process (e.g., a later transformation performed to verify the cartridge) of the authentication bit sequence and/or a copy of the authentication bit sequence used to verify the cartridge. The transformed bit sequence of the illustrated example is then written (e.g., encoded) to the memory of the cartridge (block 606). In particular, a programming device writes the transformed bit sequence to a ROM or EPROM of the cartridge. After the memory of the cartridge is programmed via the programming device, for example, the process ends (block 608).

Figure 7:
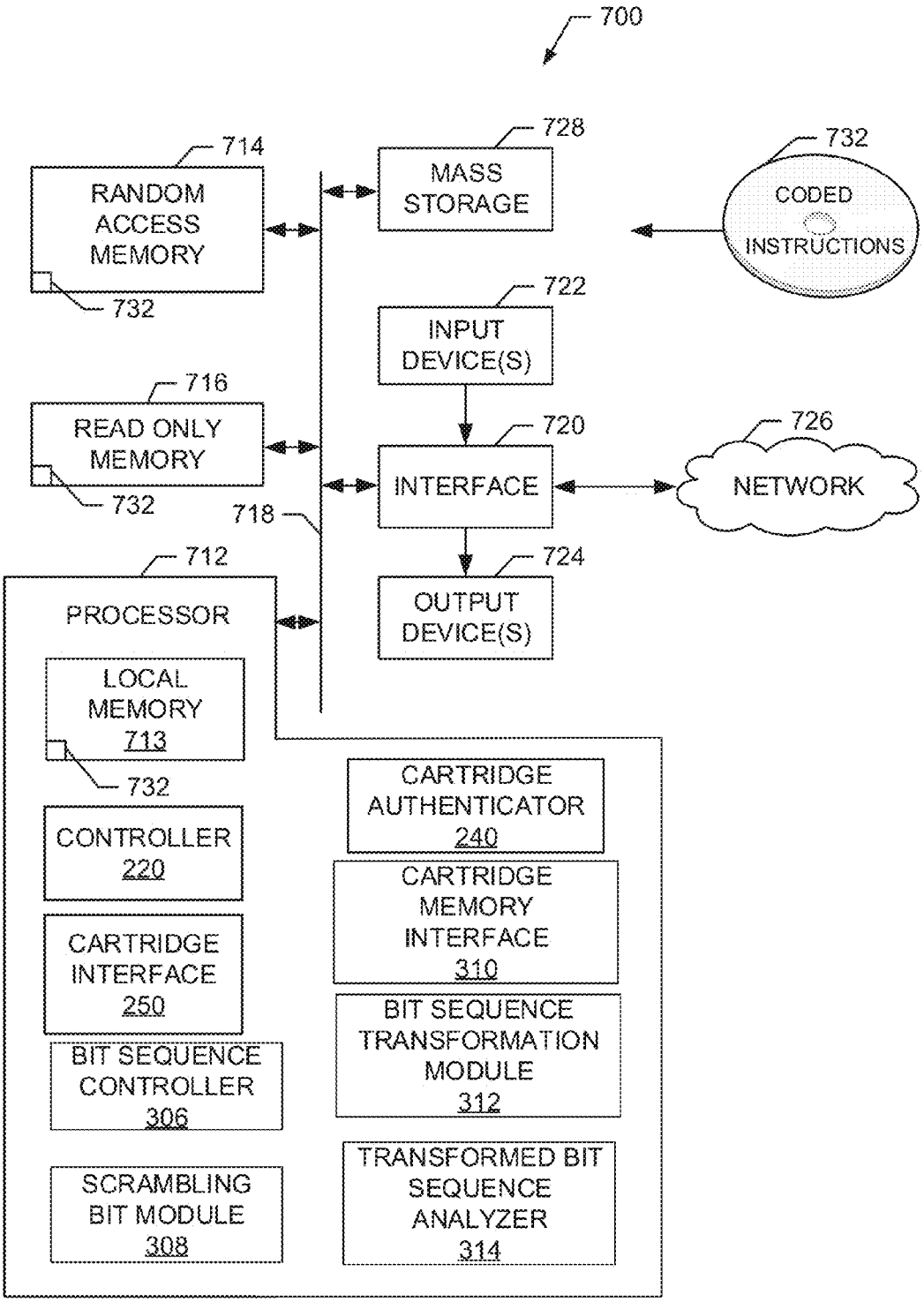
FIG. 7 is a block diagram of an example processor platform capable of executing the example machine readable instructions of FIGS. 5 and 6.

FIG. 7 is a block diagram of an example processor platform 700 capable of executing the instructions of FIGS. 5 and 6 to implement the example cartridge authentication system 200 of FIG. 2. The processor platform 700 can be, for example, a server, a personal computer (PC), a cartridge programmer, a printer, an imaging device, a mobile device (e.g., a cell phone, a smart phone, a tablet such as an iPad™), a personal digital assistant (PDA), an Internet appliance a digital video recorder, a gaming console, a personal video recorder, a set top box, or any other type of computing device.

The processor platform 700 of the illustrated example includes a processor 712. The processor 712 of the illustrated example is hardware. For example, the processor 712 can be implemented by one or more integrated circuits, logic circuits, microprocessors or controllers from any desired family or manufacturer.

The processor 712 of the illustrated example includes a local memory 713 (e.g., a cache). The processor 712 includes the example controller 220, the example cartridge authenticator 240, the example cartridge interface 250, the example bit sequence controller 306, the scrambling bit module 308, the example cartridge memory interface 310, the example bit sequence transformation module 312, and the example transformed bit sequence analyzer 314. The processor 712 of the illustrated example is in communication with a main memory including a volatile memory 714 and a non-volatile memory 716 via a bus 718. The volatile memory 714 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 716 may be implemented by flash memory and/or any other desired type of memory device. Access to the main memory 714, 716 is controlled by a memory controller.

The processor platform 700 of the illustrated example also includes an interface circuit 720. The interface circuit 720 may be implemented by any type of interface standard, such as an Ethernet interface, a universal serial bus (USB), and/or a PCI express interface.

In the illustrated example, one or more input devices 722 are connected to the interface circuit 720. The input device(s) 722 permit(s) a user to enter data and commands into the processor 712. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 724 are also connected to the interface circuit 720 of the illustrated example. The output devices 724 can be implemented, for example, by display devices (e.g., a light emitting diode (LED), an organic light emitting diode (OLED), a liquid crystal display, a cathode ray tube display (CRT), a touchscreen, a tactile output device, a printer and/or speakers). The interface circuit 720 of the illustrated example, thus, typically includes a graphics driver card, a graphics driver chip or a graphics driver processor.

The interface circuit 720 of the illustrated example also includes a communication device such as a transmitter, a receiver, a transceiver, a modem and/or network interface card to facilitate exchange of data with external machines (e.g., computing devices of any kind) via a network 726 (e.g., an Ethernet connection, a digital subscriber line (DSL), a telephone line, coaxial cable, a cellular telephone system, etc.).

The processor platform 700 of the illustrated example also includes one or more mass storage devices 728 for storing software and/or data. Examples of such mass storage devices 728 include floppy disk drives, hard drive disks, compact disk drives, Blu-ray disk drives, RAID systems, and digital versatile disk (DVD) drives.

The coded instructions 732 of FIGS. 5 and 6 may be stored in the mass storage device 728, in the volatile memory 714, in the non-volatile memory 716, and/or on a removable tangible computer readable storage medium such as a CD or DVD.

From the foregoing, it will be appreciated that the above disclosed methods, apparatus and articles of manufacture provide encryption techniques to encrypt a cartridge and/or interpret an authentication memory of a cartridge to authenticate the cartridge for verification with an imaging device. The examples disclosed herein may also reduce and/or eliminate a need for transmission and/or update of encryption keys by defining scrambling bits from a portion of an authentication memory.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus for a fluid cartridge, the apparatus comprising:

a memory, a plurality of sequential bits stored within the memory, the sequential bits including scrambling bits, the plurality of sequential bits written to the memory after the plurality of sequential bits was transformed based on the scrambling bits of the plurality of sequential bits; and a memory interface associated with the memory to enable access to the memory to authenticate the fluid cartridge by verifying the plurality of sequential bits based on the scrambling bits.

2. The apparatus as defined in claim 1, wherein the plurality of sequential bits are transformed recursively.

3. The apparatus as defined in claim 1, wherein the plurality of sequential bits further includes static bits that are excluded from being transformed.

4. The apparatus as defined in claim 3, wherein the static bits include the scrambling bits.

5. The apparatus as defined in claim 3, wherein the plurality of sequential bits are transformed further based on the static bits.

6. The apparatus as defined in claim 1, wherein the memory includes an EPROM memory device.

7. An apparatus for use with a fluid cartridge, the apparatus comprising:

a printed circuit board; and a memory carried by the printed circuit board, the memory containing a plurality of sequential authentication bits, the sequential authentication bits including scrambling bits, the plurality of sequential authentication bits having been transformed based on the scrambling bits of the plurality of sequential authentication bits prior to the plurality of sequential authentication bits being written to the memory, the fluid cartridge to be authenticated by verifying the plurality of sequential authentications bits based on the scrambling bits.

8. The apparatus as defined in claim 7, wherein the plurality of sequential authentication bits includes static bits excluded from being transformed.

9. The apparatus as defined in claim 8, wherein the static bits are at defined address locations of the memory.

10. The apparatus as defined in claim 8, wherein the plurality of sequential authentication bits are transformed further based on the static bits.

11. The apparatus as defined in claim 7, wherein the printed circuit board is carried by the fluid cartridge.

12. The apparatus as defined in claim 7, wherein the memory includes an EPROM device.

* * * * *